US008608261B2

(12) United States Patent
Retchloff et al.

(10) Patent No.: US 8,608,261 B2
(45) Date of Patent: Dec. 17, 2013

(54) DRAWER LATCH

(75) Inventors: Barry Retchloff, Rogersville, MO (US); Runzhao Chen, Foshan (CN)

(73) Assignee: Quality Craft Industries Inc., Rogersville, MO (US)

( * ) Notice: Subject to any disclaimer, the term of this patent is extended or adjusted under 35 U.S.C. 154(b) by 446 days.

(21) Appl. No.: 12/820,657

(22) Filed: Jun. 22, 2010

(65) Prior Publication Data

US 2011/0309730 A1 Dec. 22, 2011

(51) Int. Cl.
*A47B 95/02* (2006.01)

(52) U.S. Cl.
USPC ..... 312/332.1

(58) Field of Classification Search
USPC ..... 312/330.1, 332.1, 333, 319.1, 348.4; 292/95, 126, 210, 121, 128; 70/85
See application file for complete search history.

(56) References Cited

U.S. PATENT DOCUMENTS

| | | | | |
|---|---|---|---|---|
| 4,681,381 | A | 7/1987 | Sevey | |
| 4,947,661 | A * | 8/1990 | Yoshida | 70/57 |
| 5,292,191 | A * | 3/1994 | Slivon | 312/332.1 |
| 5,435,640 | A | 7/1995 | Holcomb | |
| 5,630,630 | A | 5/1997 | Price et al. | |
| 5,775,140 | A | 7/1998 | Hallsten | |
| 5,785,398 | A | 7/1998 | Park | |
| 6,547,289 | B1 * | 4/2003 | Greenheck et al. | 292/126 |
| 6,851,286 | B2 | 2/2005 | Dube et al. | |
| 7,048,347 | B1 * | 5/2006 | Liu | 312/332.1 |
| RE40,267 | E | 4/2008 | Mehmen | |
| 2009/0250944 | A1 | 10/2009 | Scheffy et al. | |
| 2011/0121701 | A1 * | 5/2011 | Chang | 312/332.1 |

FOREIGN PATENT DOCUMENTS

| | | | |
|---|---|---|---|
| CA | 2684053 | A1 | 6/2008 |

* cited by examiner

*Primary Examiner* — James O Hansen
(74) *Attorney, Agent, or Firm* — Ohlandt, Greeley, Ruggiero & Perle, L.L.P.

(57) ABSTRACT

A drawer latch assembly. The assembly provides a catch member which is mechanically connected but a separate component from the drawer handle. The drawer handle and catch operate in a concerted pivoting motion and pivot about a common fastener. The drawer handle provides a pair of arms which extend through the front wall of the drawer and have terminal end portions which include the cut out segment which locates and receives a portion of the latch member. In this manner the latch and terminal end portions of the arms are keyed together which alleviates stress on the pivot point and allows for easy repair of the arrangement in the event that either the handle or the catch become damaged.

16 Claims, 7 Drawing Sheets

DRAWER LATCH

TECHNICAL FIELD

The present invention relates to a drawer latch and more particularly, the present invention relates to an improved drawer latch having a key like receiving member for receiving a catch.

BACKGROUND OF THE INVENTION

It is well established that there are a number of drawer latches which have been established in the art previously. In the instant situation, the latch is particularly directed towards tool cabinets Such tool cabinets are known as mechanics' tool cabinets and typically have telescopic slides for the drawers with a cabinet formulated out of, for example, sheet metal. These cabinets often include a lock mechanism to prevent unauthorized access to the cabinet. In recent years the cabinets have become even more elaborate with the addition of lighting, power bars and other accessories.

In terms of the latch systems that have been set forth for such cabinets, in United States re issued U.S. Pat. No. RE 40,267, reissued Apr. 29, 2008, Mehmen discloses a drawer latch. The disclosure indicates that the drawer latch includes a lock mechanism where the arrangement includes a pivotal handle bar at the top edge of a cabinet drawer front wall. The handle provides catches biased engaging with a strike extending from the slides of the drawers mounted on the inside of the cabinet. Rotation of the handle moves the handle and therefore the catches out of engagement with the strike enabling the cabinet drawer to be opened. Although this is a useful arrangement, the drawer catches are positioned within the interior volume of the drawer which, can lead to breakage of the catch or bending of the catch which would therefore render the drawer inoperative.

Further, in United States patent application publication number US 2009/0250944, published Oct. 8, 2009, Scheffy et al teach a full width overlaid drawer latch. In the embodiment as shown, the drawer latch provides an overlay where the catch is positioned on opposed sides of the drawer handle. The catch engages a latch receiver in the frame of the cabinet. The latch receivers are vertically oriented.

The system is effective, however, it is somewhat limited in that in the event that the drawer handle becomes damaged or, for that matter, the catch itself becomes damaged, the entire drawer handle would have to be replaced, thus presenting an expensive proposition.

In U.S. Pat. No. 7,121,638, issued to Eggert et al, Oct. 17, 2006, there is disclosed a drawer latch suitable for use in the cabinets discussed hereinabove. The arrangement provides a drawer pull having a latch that is slideably positioned under the drawer for longitudinal sliding between the latching and unlatching positions. The document indicates that a latch is integrally positioned on one end of the latch and has a latch surface. A protrusion surface is coupled to the cabinet and exposed such that it is in an abutting relation with the latch when the drawer is in the closed position and the latch is in latching position. The non-abutting relationship occurs when the latch is in the unlatching position. The spring is also provided on the latch for biasing purposes.

In the analysis of the structure, it is evident that it is fairly involved from a mechanical point of view which results in a greater number of parts and thus enhanced manufacturing costs.

Dubé at al in, U.S. Pat. No. 6,851,286, issued Feb. 8, 2005 teaches a frontal latch handle assembly. The arrangement includes a block mounted on the front panel of the drawer and a latch movable with respect to block between the locking position and a unlocking position. A mechanism is provided which is responsive to the movement of the handle and particularly for moving the latch member between the lock and unlocked positions.

There are variations on the lockable drawer system included that disclosed in U.S. Pat. No. 4,681,381, issued to Sevey, Jul. 21, 1987, U.S. Pat. No. 5,435,640, issued Jul. 25, 1995, to Holcomb, U.S. Pat. No. 5,630,630, issued to Price et al, May 20, 1997, U.S. Pat. No. 5,775,140, issued to Hallsten, Jul. 7, 1998 and U.S. Pat. No. 5,785,398, issued Jul. 28, 1998, to Park.

Despite the fact that there is a plethora of drawer latch systems and their related components, it would appear that the art has not recognized a straight forward mechanical system which provides a separate latch component which is mechanically connected, but separate to the drawer pull and positioned such that the movable components are behind a front wall of the drawer thus affording protection against inadvertent damage. The present invention has addressed this need with the mechanical arrangement set forth herein.

SUMMARY OF THE INVENTION

One object of the present invention is to provide an improved drawer latch mechanism. Further object of one embodiment of the present invention is to provide a sliding drawer assembly, comprising:

a cabinet frame;

a drawer slidably coupled to said cabinet frame, the drawer having a front wall, back wall and spaced apart side walls;

a drawer handle pivotally connected to each sidewall of the sidewalls;

receiving means on the drawer handle for receiving at least a portion of a catch member; and a catch member pivotally connected to a sidewall of said sidewalls independently of the drawer handle and releasably engageable with the cabinet frame, at least a portion of the catch member received within the receiving means such that movement of the drawer handle effects movement of the catch member for releasable engagement with the cabinet frame.

Advantageously, the arrangement set forth herein may be mechanically biased or naturally biased by weight such that the catch member is always directed in a pivoted disposition upwardly. This may be achieved by weighting the drawer handle such that the weight is favoured so that the drawer handle is directed downwardly or, alternatively, a separate biasing device may be incorporated into the structure.

Of particular convenience with the instant structure is the fact that the drawer handle provides two arms which extend through slots in the front wall of the drawer. The terminal ends of the arms include a cut out segment which receives at least a portion of the catch member. In this manner, the catch member and the arms of the drawer handle are effectively "around keyed" and move in concert above a common fastener. The "keying" aspect is particularly effective to prevent significant mechanical stresses at the pivot point and further, allows for easy repair to the catch without extensive disassembly or, more importantly, without having to replace the entire drawer pull as was characteristic with the arrangements in the prior art.

A further object of one embodiment of the present invention is to provide a sliding drawer assembly having a cabinet frame, a drawer slideably coupled to the cabinet frame, the drawer having a front wall, back wall and spaced apart side walls, a drawer handle pivotally connected to each sidewall of the sidewalls, the improvement comprising:

receiving means on the drawer handle for receiving at least a portion of a catch member; and a catch member pivotally connected to a sidewall of the sidewalls independently of the drawer handle and releasably engageable with the cabinet frame, at least a portion of the catch member received within the receiving means such that movement of the drawer handle effects movement of the catch member for releasable engagement with the cabinet frame.

Considering the fact that the drawer has a large front wall, the same advantageously acts to protect the latch mechanism against inadvertent damage. This also contributes to the use of the biasing means which extends between the latch member and the back portion of the wall which faces the interior of the drawer. By this arrangement, any suitable biasing means can be used such as a spring, of the helical or leaf variety inter alia.

A still further object of one embodiment of the present invention is to provide a drawer latch, comprising:

a drawer having a front wall, spaced apart sidewalls and a rear wall;

a catch member pivotally connected to at least one of the sidewalls and the front wall and adapted to catch a frame component of a frame receiving the drawer;

a handle member pivotally connected to the catch member, the handle member and the catch member comprising independent members connected by a common fastener; and receiving means on the drawer handle for receiving at least a portion of the catch member, the receiving means for locating and receiving the portion, whereby pivotal movement of the handle member effects concerted pivotal movement of the catch member from a latched position with the frame component to a released position where the catch member is disengaged from the frame component.

Although it has been discussed herein that the arrangement is directed to a mechanic's tool cabinet, the arrangement can easily be incorporated on any drawer system to prevent unauthorized access.

Yet another object of one embodiment is to provide kit for latching a drawer in a cabinet, comprising:

a handle for extension through a front wall of a drawer receiving means on the drawer handle for receiving at least a portion of a catch member;

a catch member adapted for pivotal connection to a sidewall of the drawer, at least a portion of the catch member received within the receiving means such that movement of the drawer handle effects movement of the catch member; and a tab adapted for fastening to an inside wall of the cabinet releasably engageable with the catch member.

Having thus generally described the invention, reference may now be made to the accompanying drawings illustrating preferred embodiments.

BRIEF DESCRIPTION OF THE DRAWINGS

Similar numerals used in the drawings denote similar elements

DETAILED DESCRIPTION OF THE PREFERRED EMBODIMENTS

Figure 1:
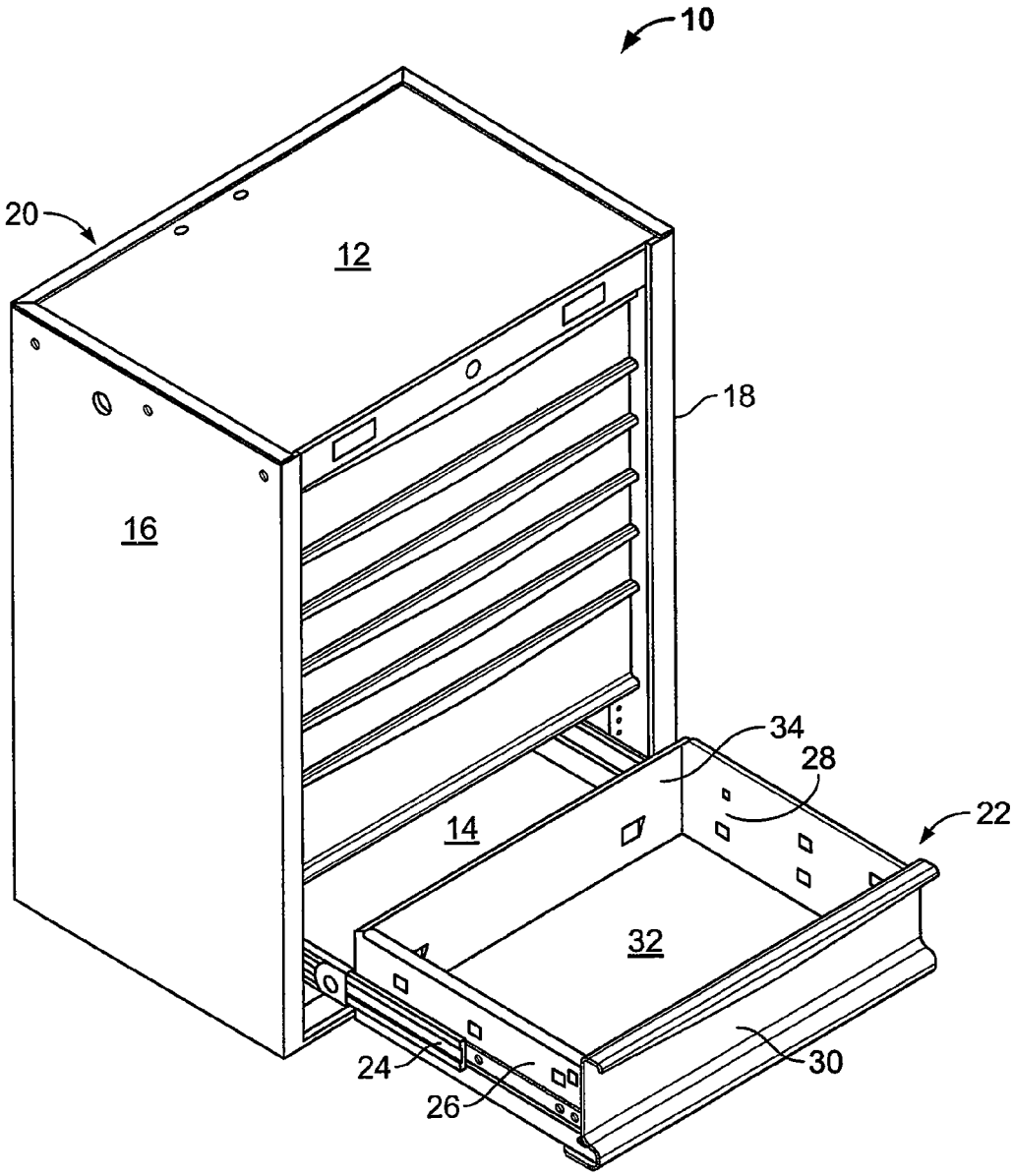
FIG. 1 is a perspective view of a tool cabinet.
Figure 2:
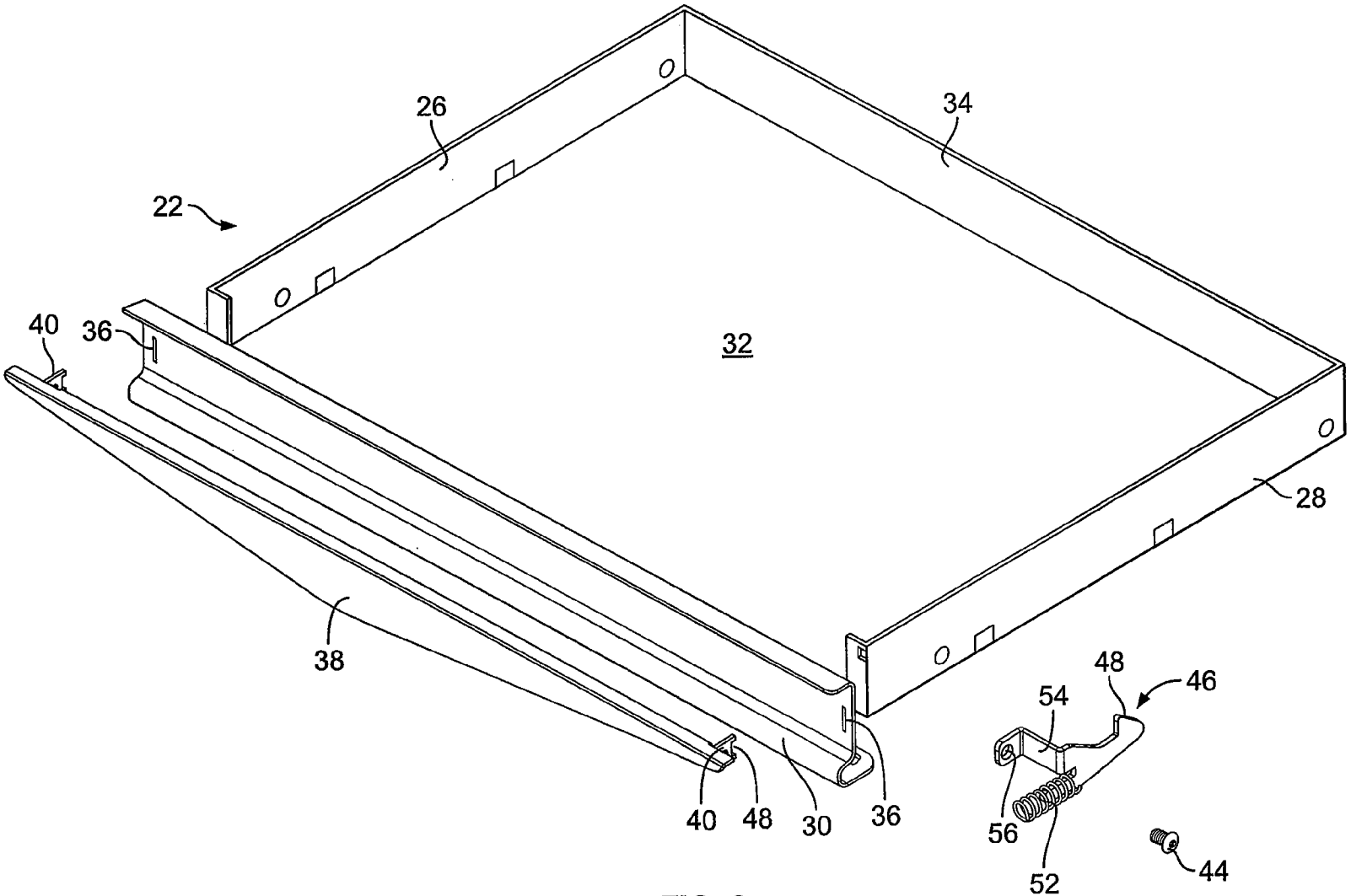
FIG. 2 is an exploded view of one embodiment of the present invention.

Referring now to FIG. 1, numeral 10 denotes a typical chest of drawers, typically used for the storage of tools. The chest includes a cabinet frame having a top 12, bottom 14, opposed side walls 16 and 18, respectively, and a back wall, generally denoted by numeral 20. As is well known, the individual drawers, generally denoted by numeral 22 have telescopic slides 24 attached to sides 26 and 28, respectively. Only one telescopic slide 24 is shown in FIG. 1. It will be understood that side 28 of drawer 22 includes a similar slide 24. The drawers each include a front wall 30, base wall 32 and back wall 34 as is typical most of these arrangements. Turning to FIG. 2, shown is more details concerning the nature of the present invention. The telescopic slides 24 have been removed from the illustration of the drawer 22 for purposes of the clarity.

In FIG. 2, front wall 30 of drawer 22 includes spaced apart apertures 36, an aperture of which is associated with opposite side of front wall 30. A drawer handle 38 opposite sides of which includes arms 40 which extend perpendicularly to the longitudinal axis of the handle 38. Arms 40 are configured to extend through apertures 36. This relationship is shown more clearly in FIG. 3. The arms 40 each include an aperture 42 for pivotal connection with a respective side wall 26 and 28, with the pivoting being provided for by fastener 44, shown in the example as a rivet. The rivet engages the apertures 42 of arms 40 once through apertures 36 of wall 30 and subsequently engages the catch member 46, described in greater detail herein after.

Each arm 40 includes a cut out section, shown in the example of a U shaped cut out and global denoted by numeral 48. The U shaped cut out is adapted to locate and retain at least a portion of the catch members 46.

With respect to greater detail concerning catch member 46, the same comprises a separate unit entirely from handle 38 and, the two members 46 and 38 are connected as briefly noted herein previously. The catch member 46 comprises a catch 48 having the shape generally of a half arrowhead. In longitudinal opposition to the catch 48 there is provided a finger 50, which finger 50 is adapted to receive a biasing member 52, shown in the example as a typical helical spring. The biasing member is such that it biases the catch in an upward or ready to engage position by biasing the catch member 46 against the inside surface of front wall 30. This is clearly illustrated in FIG. 3. Intermediate of the body of catch 46 there is provided spacing member 54. The spacing member 54 is in an orthogonal relationship to the longitudinal axis of the catch member 46 and terminates with an eyelet 56. 56 receives rivet 44.

Figure 3:
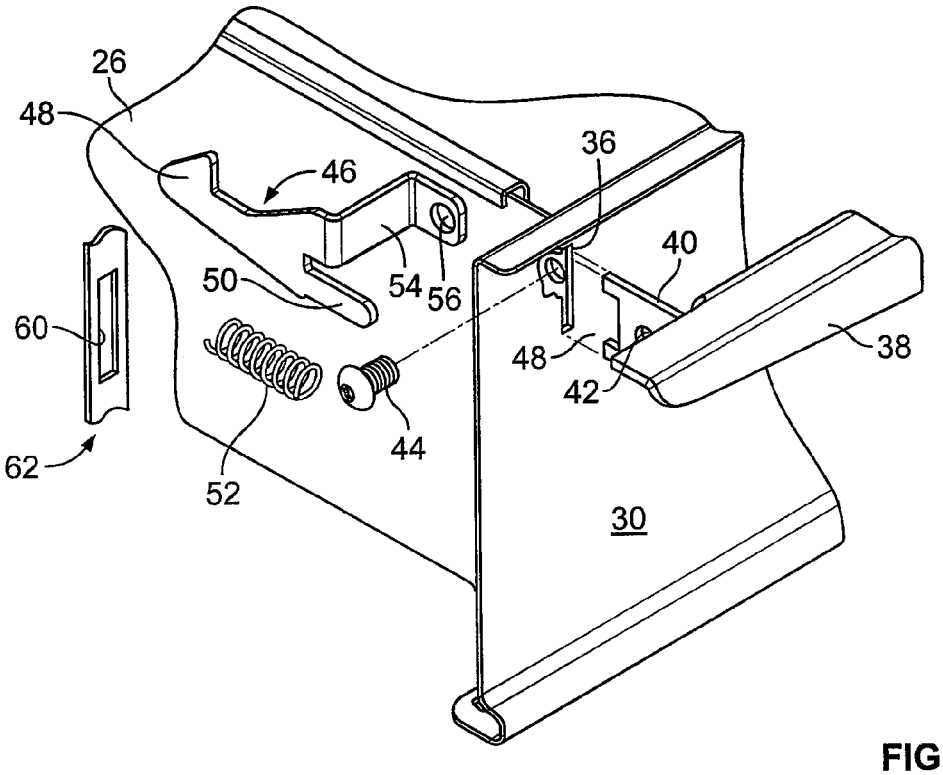
FIG. 3 is an enlarged partially cut away view of FIG. 2.

As is illustrated in FIG. 3, once connected, arms 40 overlie the eyelet area 56 with the U shaped cut out retaining member 48 engages at least a portion of the spacer 54. Apertures 42 of the arms 40 receive the rivet. Accordingly, arms 42 overlie the eyelet 56 while the U shaped cut out engages spacer 54. In this manner, the catch 46 is effectively in keying or keyed relation with the handle 38. The biasing member 52 urges the catch in an upward inclination or in a engaging position.

One of the more convenient features of the arrangement is that the catch arrangement is not only spaced with the respective side wall 26, 28 of drawer 22, but further, the entire catch arrangement is behind front wall. This offers some degree of protection against damage.

As a further particularly convenient advantage associated with this structure, the fact that the drawer handle and catch arrangement are two distinct components allow for easy repair of either one of these elements without extensive expense to replace an entire catch and handle assembly of a typically associated with prior art arrangements. Further, by positioning the pivoting action of the arrangement along a respective side wall, the overall catch arrangement benefits from the structural integrity provided by the connection between a front wall and respective side wall as well as the base wall 32.

As shown in FIG. 3, the catch 46 is received within a slot 60 of a cabinet frame member 62. Cabinet frame member 62 comprises a vertical wall is adapted to receive in engaged relation, as shown in FIG. 3, catch 48 of catch member 46 such that the drawer will not be inadvertently released from movement via the telescopic slides 24. Although it is shown in FIG. 3 that the biasing member 50 biases the catch 48 into connection with member 60, it will be appreciated by those skilled in the art that in the absence of the biasing member 50, handle 38 could simply be weighted with, for example, additional material on handle 38, in terms of separate weights or additional thickness during manufacturing of the handle 38 to always bias the catch 46 into an upward disposition so that it is engaged within member 60.

It will be appreciated by those skilled in the art that the arrangement set forth herein can be easily applied to any type of drawer system, for example filing cabinets, kitchen drawers, safe keeping drawers, etc.

Figure 4:
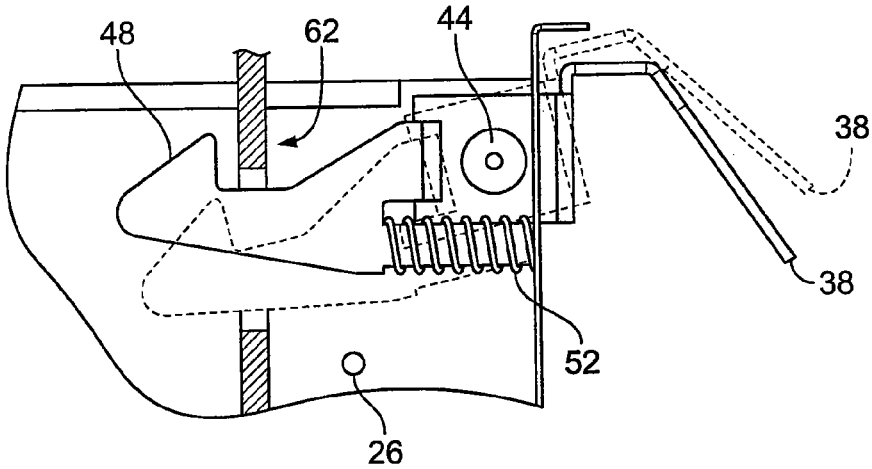
FIG. 4 is a cut away side view to FIG. 3.
Figure 5:
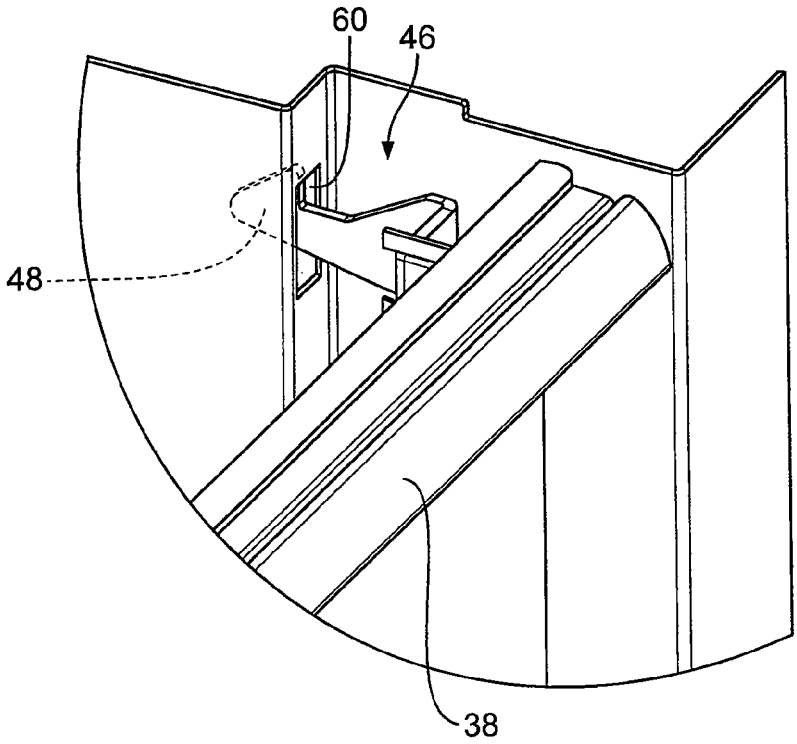
FIG. 5 is a partially cut away similar to FIG. 3.

FIGS. 4 and 5 provide cut away views illustrating the arrangement of the component members and the interaction.

Figure 6:
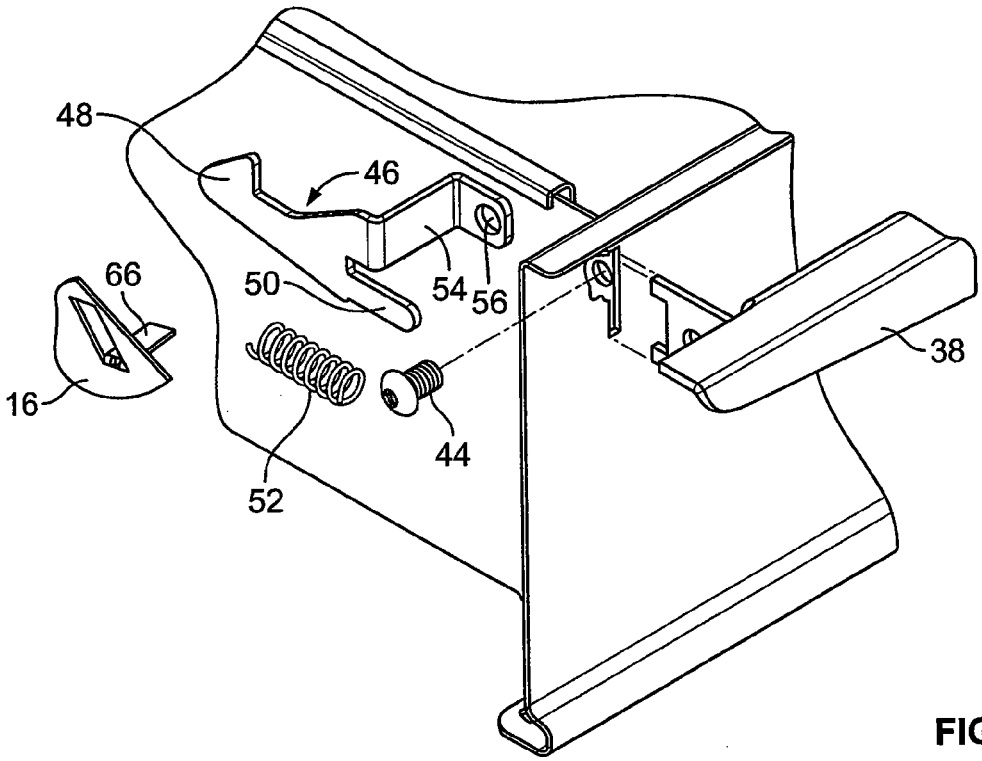
FIG. 6 is a view similar to FIG. 3 of an alternate embodiment.
Figure 7:
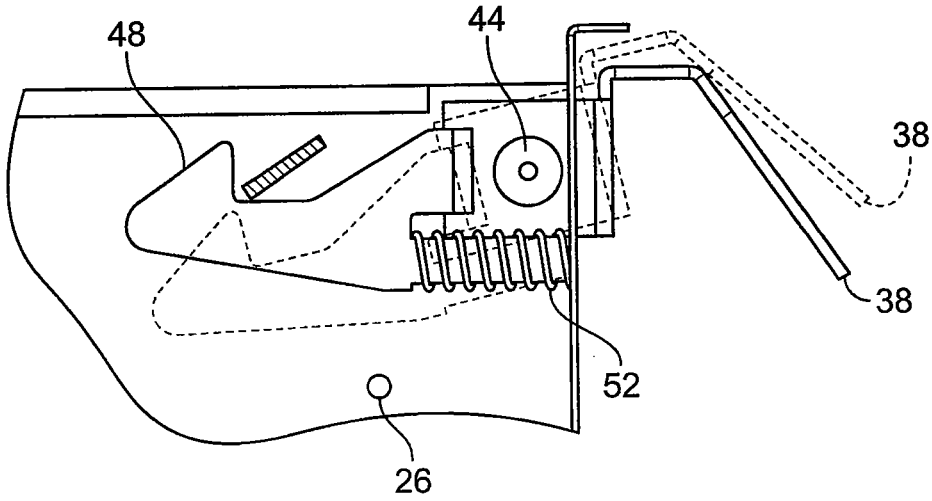
FIG. 7 is a view similar to FIG. 4 for the alternate embodiment.
Figure 8:
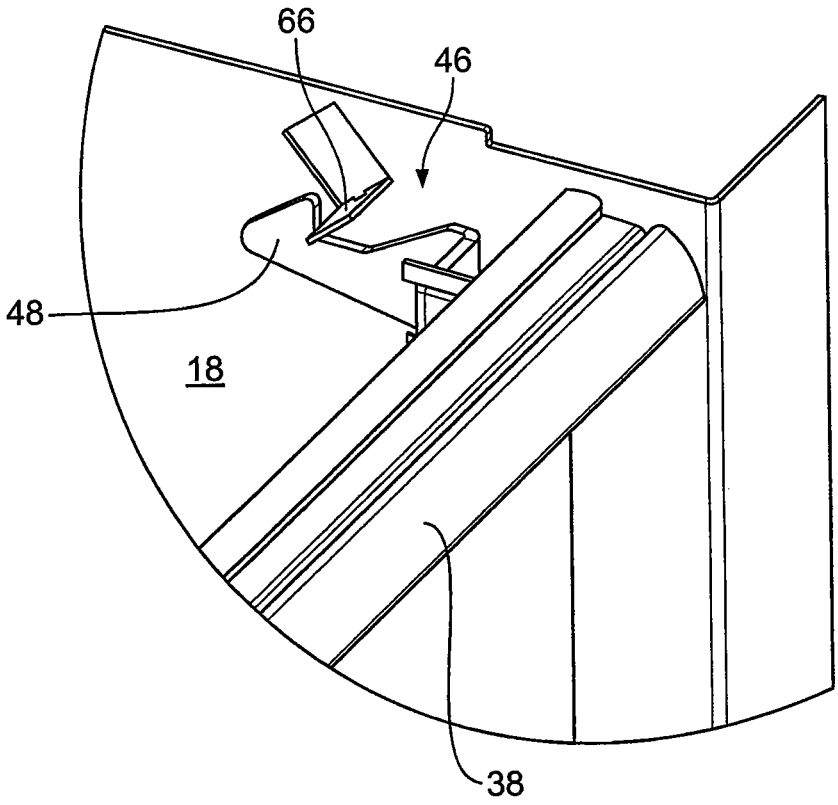
FIG. 8 is a view similar to FIG. 5 for the alternate embodiment.

In the realm of additional embodiments, FIGS. 6 through 8 show views of a further embodiment of the present invention.

In this embodiment, cabinet member 62 having slot 60 is replaced with a cut out tab 66, simply comprising, as an example, a projecting tab 66 cut (stamped) out of a respective sidewall 16 or 18 of the chest 10 (FIG. 1). Engagement of tab 66 is shown in FIGS. 7 and 8.

Figure 9:
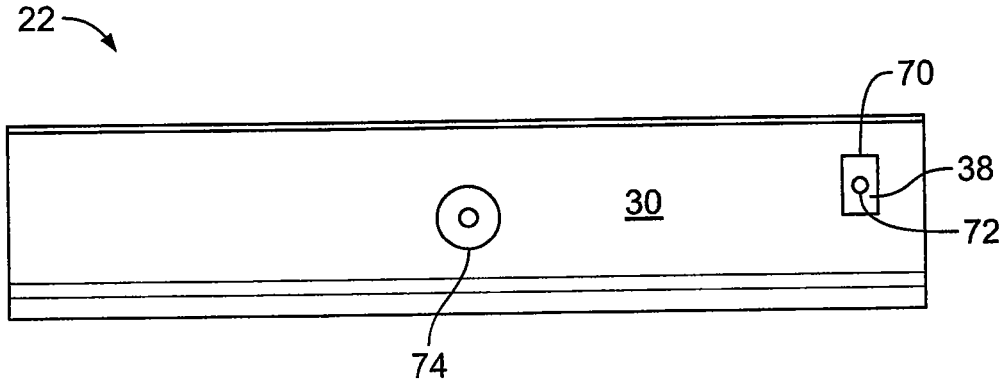
FIG. 9 is a front view of a drawer for use with an alternate embodiment.
Figure 10:
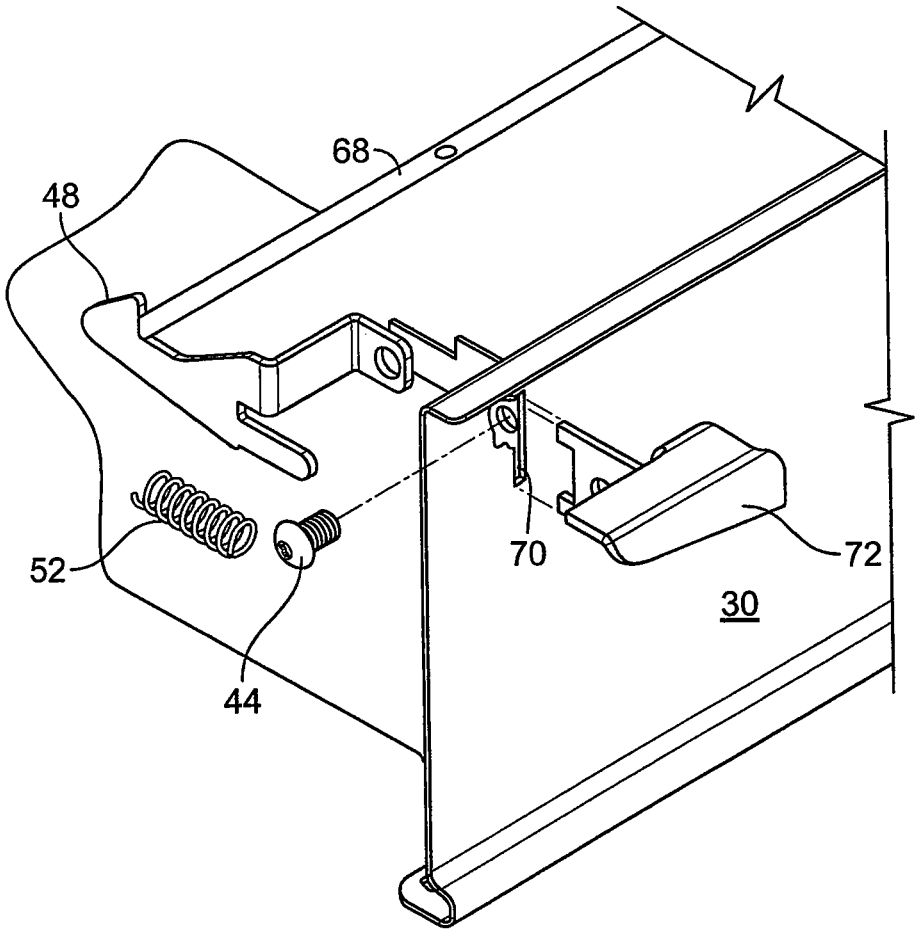
FIG. 10 is a partially cut away view of a side view of FIG. 9.
Figure 11:
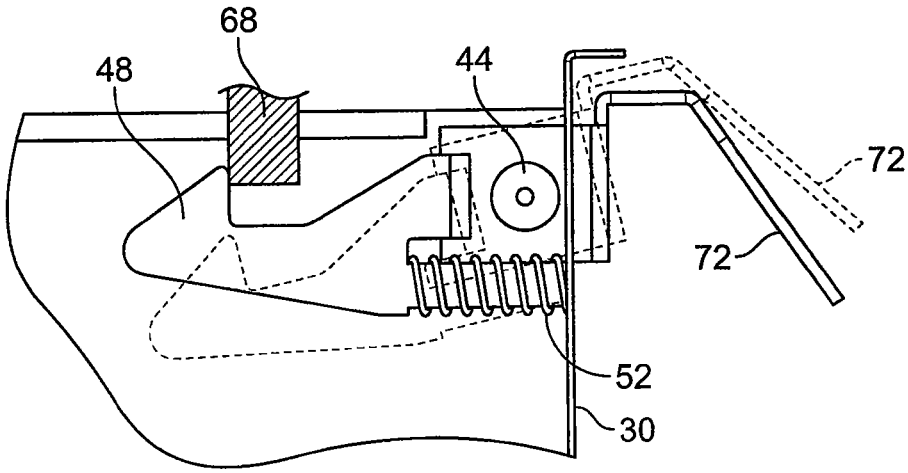
FIG. 11 is a partially cut away side view of the embodiment shown in FIG. 10 and the engagement disposition with a frame member.

Referring now to FIGS. 9 through 11, shown are views of yet another embodiment of the present invention. In this embodiment, the drawer illustrated is a typical kitchen drawer with the catch 48 engaged with a frame member 68 associated with the kitchen cabinetry In this embodiment, the front of the drawer 22 is modified by providing an aperture 70 in the front panel 30 of drawer 22 for accessing a handle member 72. The handle member 74 would include all of the features noted herein previously with respect to the overall catch structure as well as the arms 40 and cut out section 48. This has been extensively discussed herein and shown in detail with respect to the other Figures. In this manner, the pre existing handle 74 on the drawer front wall 30 would serve to prevent, for example, children from opening the drawer owing to the fact that they would not be mindful of the catch Accordingly, the existing drawer arrangements could be easily retrofitted with the handle member and its associated features as well as the catch 46 to allow usage of the components and to prevent unwanted access to the drawer onto which the structure is mounted.

Figure 12:
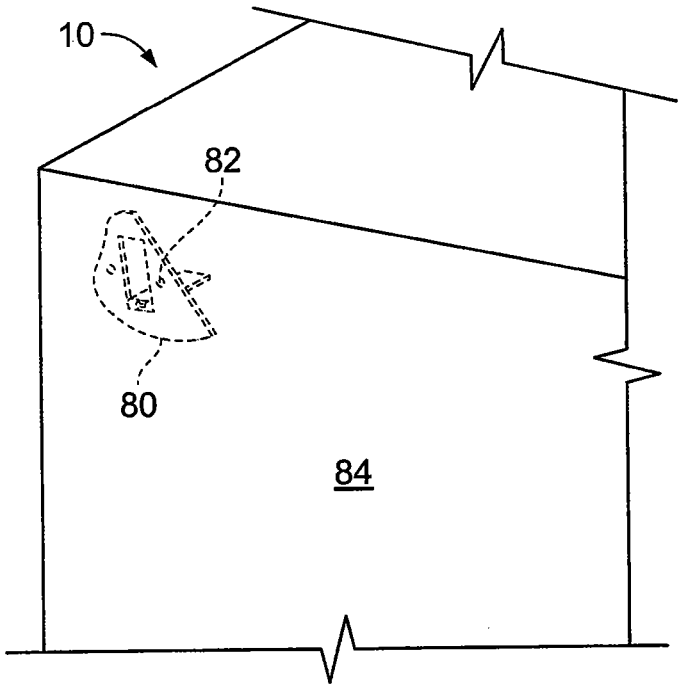
FIG. 12 is a partially cut away view of an alternate embodiment.

As a further example, the embodiment, the arrangement as illustrated in FIG. 10 could be a kit arrangement for use on existing cabinetry. The cut out tab 66 may include a body 80, as illustrated in FIG. 12 with fastener openings 82 or simply include adhesive for attachment to the inside surface 84 of cabinet 10. In this manner, the catch and related elements of FIG. 6 could be retrofitted to existing structures.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A sliding drawer assembly, comprising:
a cabinet frame;
a drawer slideably coupled to said cabinet frame, said drawer having a front wall, back wall and spaced apart side walls;
a drawer handle pivotally connected to each sidewall of said sidewalls;
receiving means on said drawer handle for receiving at least a portion of a catch member; and
a catch member pivotally connected to a sidewall of said sidewalls independently of said drawer handle and releasably engageable with said cabinet frame, at least a portion of said catch member received within said receiving means such that movement of said drawer handle effects movement of said catch member for releasable engagement with said cabinet frame, wherein said drawer handle is weighted to bias said catch member in an upwardly directed position to engage said cabinet frame.

2. The assembly as set forth in claim 1, wherein said catch member is biased in an upwardly directed position with biasing means.

3. The assembly as set forth in claim 2, wherein said biasing means comprises a spring.

4. The assembly as set forth in claim 2, wherein said catch member includes retaining means for retaining said biasing means.

5. The assembly as set forth in claim 4, wherein said biasing means extends between said retaining means and said front wall.

6. The assembly as set forth in claim 1, wherein said drawer handle includes a pair of spaced apart arms, an arm of said pair extending through said front wall on opposed sides thereof.

7. The assembly as set forth in claim 6, wherein each arm of said arms includes an aperture for receiving a fastener to enable pivotal movement of said drawer handle.

8. The assembly as set forth in claim 7, wherein each of said arms includes a terminal end, said terminal end having said receiving means.

9. The assembly as set forth in claim 6, wherein said spaced apart arms are integrally connected with said drawer handle.

10. The assembly as set forth in claim 1, wherein said receiving means comprises a channel.

11. In a sliding drawer assembly having a cabinet frame, a drawer slideably coupled to said cabinet frame, said drawer having a front wall, back wall and spaced apart side walls, a drawer handle pivotally connected to each sidewall of said sidewalls, the improvement comprising:

receiving means on said drawer handle for receiving at least a portion of a catch member;

a catch member pivotally connected to a sidewall of said sidewalls independently of said drawer handle and releasably engageable with said cabinet frame, at least a portion of said catch member received within said receiving means such that movement of said drawer handle effects movement of said catch member for releasable engagement with said cabinet frame, and biasing means for biasing said catch member in an upwardly directed position to engage said cabinet frame.

12. The assembly as set forth in claim 11, wherein said receiving means comprises a channel configured to locate and receive at least a portion of said catch member.

13. The assembly as set forth in claim 11, wherein said drawer handle includes a pair of spaced apart arms, an arm of said pair extending through said front wall on opposed sides thereof.

14. The assembly as set forth in claim 13, wherein said arms and said catch member are separate and independent members.

15. The assembly as set forth in claim 14, wherein said arms and said catch member are mechanically connected with fastener means to enable pivotal movement.

16. The assembly as set forth in claim 15, wherein said channel of said receiving means and said fastener means cooperate to facilitate concerted movement of said catch member and said drawer handle.

* * * * *